US009912036B2

(12) United States Patent
Whitley et al.

(10) Patent No.: US 9,912,036 B2
(45) Date of Patent: Mar. 6, 2018

(54) METHOD AND APPARATUS FOR OPTIMAL ANTENNA ALIGNMENT

(71) Applicant: Echostar Technologies LLC, Englewood, CO (US)

(72) Inventors: Samuel Whitley, Cheyenne, WY (US); Silas Cole, Cheyenne, WY (US)

(73) Assignee: Echostar Technologies L.L.C., Englewood, CO (US)

( * ) Notice: Subject to any disclaimer, the term of this patent is extended or adjusted under 35 U.S.C. 154(b) by 864 days.

(21) Appl. No.: 14/447,328

(22) Filed: Jul. 30, 2014

(65) Prior Publication Data

US 2016/0036117 A1 Feb. 4, 2016

(51) Int. Cl.
*H01Q 1/12* (2006.01)
*H01Q 3/00* (2006.01)

(52) U.S. Cl.
CPC ..... *H01Q 1/125* (2013.01); *H01Q 3/005* (2013.01)

(58) Field of Classification Search
CPC ..... H01Q 1/125; H01Q 3/005
See application file for complete search history.

(56) References Cited

FOREIGN PATENT DOCUMENTS

WO WO 03/077359 A2 * 9/2003 ..... H01Q 1/125

OTHER PUBLICATIONS

S.T. Rockwell, A model of SNR degradation during solar conjunction, Jet Propulsion Lab., California Inst. of Tech., Pasadena, The Deep Space Network, 1977.*

K.T. Lin et al., A Sun Interference Prediction Program, COMSAT Technical Review, vol. 19(2), p. 311-332, 1989.*

* cited by examiner

*Primary Examiner* — Bernarr E Gregory
*Assistant Examiner* — Fred H Mull
(74) *Attorney, Agent, or Firm* — Kilpatrick Townsend & Stockton LLP

(57) ABSTRACT

An approach for determining remote terminal antenna alignment in a satellite communications system is provided. A point in time for an expected conjunction of an a remote terminal antenna, a satellite in communication with the remote terminal and the Sun is determined based on predetermined positional data. An interference level imposed by the Sun on communication signals between the antenna and the satellite is measured at a number of respective points in time. A one of the points in time is determined when the interference is at a peak level. Then information regarding alignment of the antenna with respect to the satellite is determined, wherein the determination of the antenna alignment information is based on a comparison between the one point in time of the peak interference level and the expected point in time of the conjunction of the antenna, the satellite and the Sun.

20 Claims, 15 Drawing Sheets

METHOD AND APPARATUS FOR OPTIMAL ANTENNA ALIGNMENT

BACKGROUND

In a communications system, such as one employing a number of Earth-based antennae directed to an orbiting satellite, preferably in geosynchronous orbit, the determination of antennae direction or pointing is critical, particularly in systems where the antennae have no or little tracking capability. For example, in the consumer satellite broadcast market (e.g., satellite broadcast television), thousands of consumer antennae or dishes point to a geosynchronous satellite for broadcast data signals (e.g., broadcast television channel content). If the alignment of a given antennae were off, then the signal quality would be diminished, the service would be degraded and the customer relationship affected.

With potentially millions of individual customers, it is difficult to regularly service each customer to determine if their antenna is properly optimized or aligned. Further, existing communications systems are generally unable to determine particular maladjusted antennae or dishes within a population of subscribers. With satellite TV and other satellite-signal services becoming more integral and critical in modern consumer entertainment and communications services, the problem of optimization, determination and correction requires attention.

Another concern of communications system owners is to maintain the fidelity of subscriber membership. Often, parties illegally intercept and pirate content by high jacking the signal feed from a subscriber satellite. The interdiction of these illegal connections is quite desirous, and a technique that both combines the improvement of signal connectivity and membership verification is greatly desired as well.

There is, therefore, a need for communications systems to ascertain the directional alignment status of antennae pointed to satellites, enabling discrete corrective measures to fix only those antennae out of alignment, thereby maintaining quality signal reception and system performance. There is also a need for a technique to better identify unauthorized users of a satellite-based subscriber service and better interdict inappropriate usage of those services.

SOME EXAMPLE EMBODIMENTS

Embodiments of the present invention advantageously address the needs above, as well as other needs, by providing an approach for periodically determining remote terminal antenna alignment in a satellite communications system, based on a naturally-occurring solar conjunction phenomenon for alignment verification.

In accordance with example embodiments of the present invention, an approach is provided for pre-computing a periodic conjunctive event between each antenna in a satellite system, with the satellite, and a peak interference position of the Sun, calculating the time and date of the occurrence. Separately, the particular antennae, in an alignment with the satellite, measures the degree of signal interference from the Sun, and determines the point of maximal interference, particularly the time and date thereof. A comparison is then made between the pre-computed time and date for conjunction, and the measured time and date of maximal interference, and conclusions are made from these measurements with regard to alignment, the lack thereof and the means to correct same. According to further example embodiments, the degree of difference between the pre-computed time and date for the conjunction between a particular antenna, the satellite and the traversing Sun, and actual measurements, by that particular antenna of the time and date of maximal interference, is computed. If the degree of difference is greater than a predetermined error amount or delta, this indicates that the particular antenna is outside the subscriber area, i.e., the region of authorized users, and further action is warranted to assess and interdict such unauthorized signal receivers.

In accordance with one example embodiment, an apparatus comprises a memory configured to store positional data for an antenna of a remote terminal. The apparatus further comprises a processor configured to determine a point in time for an expected conjunction of the antenna, a satellite in communication with the remote terminal and the Sun, based at least in part on the positional data. The apparatus additionally comprises a detector configured to measure, at each of a plurality of points in time, a respective interference level imposed by the Sun on communication signals between the antenna and the satellite. The processor is further configured to determine a one of the points in time when the interference level is at a peak level, and to determine information regarding alignment of the antenna with respect to the satellite, wherein the determination of the antenna alignment information is based at least in part on a comparison between the one point in time of the peak interference level and the expected point in time of the conjunction of the antenna, the satellite and the Sun. By way of further example, depending on the comparison between the one point in time of the peak interference level and the expected point in time of the conjunction of the antenna, the satellite and the Sun, the processor initiates transmission of an alignment signal indicating positive alignment, an alignment whereby the one point in time of the peak interference level leads the expected point in time of the conjunction of the antenna, the satellite and the Sun, or an alignment whereby the one point in time of the peak interference level lags the expected point in time of the conjunction of the antenna, the satellite and the Sun. By way of further example, the processor is further configured to determine an unauthorized operation of a remote terminal based on one or more of the one point in time of the peak interference level, the comparison between the one point in time of the peak interference level and the expected point in time of the conjunction of the antenna, the satellite and the Sun, and the antenna alignment information.

In accordance with a further example embodiment, a method comprises determining a point in time for an expected conjunction of an antenna of a remote terminal, a satellite in communication with the remote terminal and the Sun, based at least in part on predetermined positional data. The method further comprises measuring, at each of a plurality of points in time, a respective interference level imposed by the Sun on communication signals between the antenna and the satellite, and determining a one of the points in time when the interference level is at a peak level. The method additionally comprises determining information regarding alignment of the antenna with respect to the satellite, wherein the determination of the antenna alignment information is based at least in part on a comparison between the one point in time of the peak interference level and the expected point in time of the conjunction of the antenna, the satellite and the Sun. By way of further example, depending on the comparison between the one point in time of the peak interference level and the expected point in time of the conjunction of the antenna, the satellite and the Sun, the method may further comprise transmitting an alignment signal indicating positive alignment, an alignment whereby the one point in time of the peak interference level leads the expected point in time of the conjunction of the antenna, the satellite and the Sun, or an alignment whereby the one point in time of the peak interference level lags the expected point in time of the conjunction of the antenna, the satellite and the Sun. By way of further example, the method further comprises determining an unauthorized operation of a remote terminal based on one or more of the one point in time of the peak interference level, the comparison between the one point in time of the peak interference level and the expected point in time of the conjunction of the antenna, the satellite and the Sun, and the antenna alignment information.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various obvious respects, all without departing from the spirit and scope of the present invention. Accordingly, the drawings and description are to be regarded as illustrative in nature, and not as restrictive.

BRIEF DESCRIPTION OF THE DRAWINGS

Embodiments of the present invention are illustrated by way of example, and not by way of limitation, in the figures of the accompanying drawings wherein like reference numerals refer to similar elements and wherein.

DETAILED DESCRIPTION

An approach for periodically determining remote terminal antenna alignment in a satellite communications system, based on a naturally-occurring solar conjunction phenomenon for alignment verification is described. In the following description, for the purposes of explanation, numerous specific details are set forth in order to provide a thorough understanding of the present invention. The present invention is not intended to be limited based on the described embodiments, and various modifications will be readily apparent. It will be apparent that the invention may be practiced without the specific details of the following description and/or with equivalent arrangements. Additionally, well-known structures and devices may be shown in block diagram form in order to avoid unnecessarily obscuring the invention. Further, the specific applications discussed herein are provided only as representative examples, and the principles described herein may be applied to other embodiments and applications without departing from the general scope of the present invention.

Figure 1:
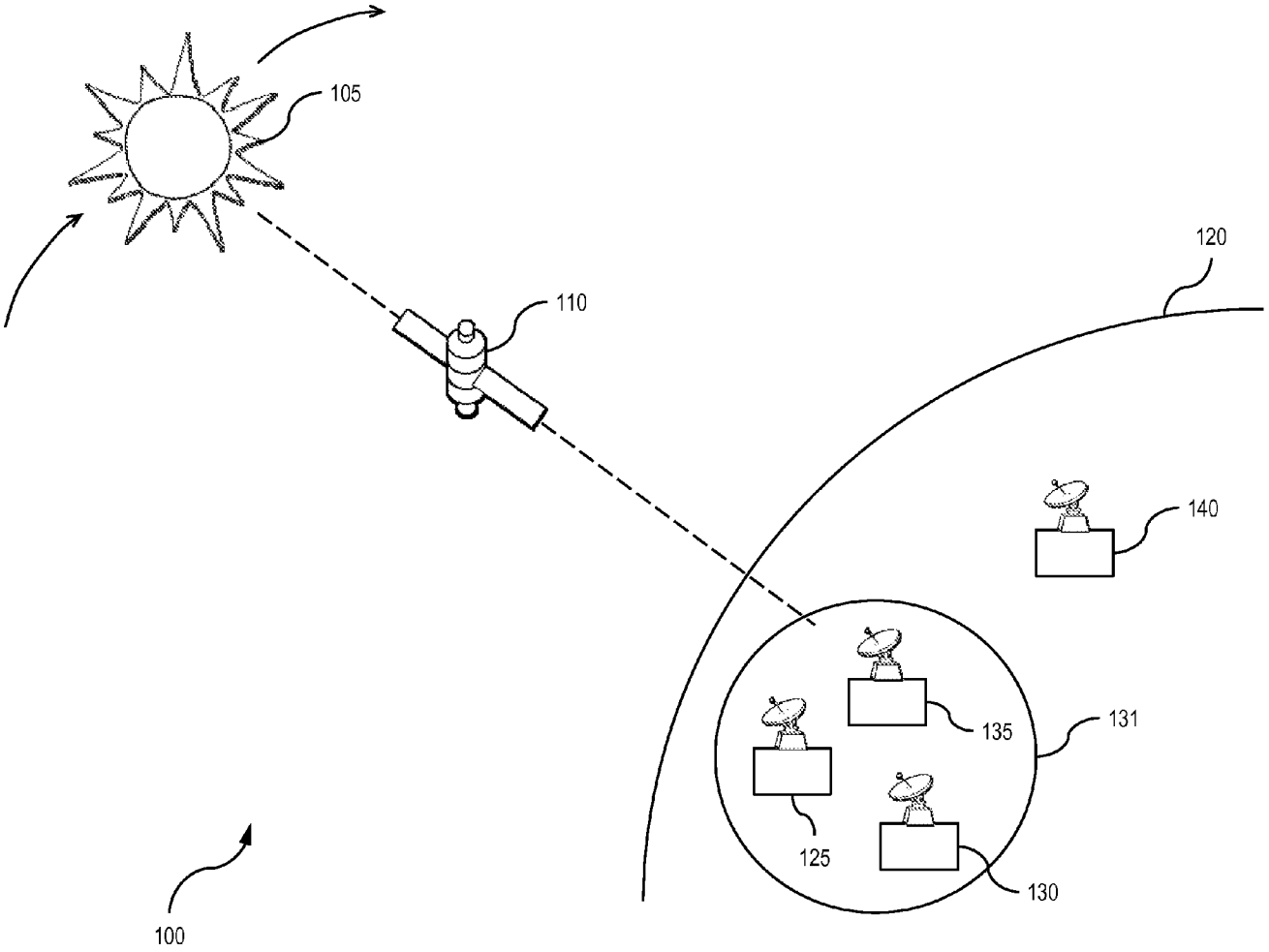
FIG. 1 illustrates a block diagram of a broadcast satellite system, where a number of remote terminals are shown in a time period of solar conjunctive alignment, in accordance with example embodiments of the present invention.

FIG. 1 illustrates a block diagram of a broadcast satellite system 100 (e.g., for a broadcast subscription communications service), where a number of remote terminals are shown in a time period of solar conjunctive alignment, in accordance with example embodiments of the present invention. A satellite 110, (e.g., in a geosynchronous orbit about the Earth 120), communicates with a number of discrete remote terminals 125, 130, 135 and 140 on the surface of the Earth. For example, such communications may comprise broadcast transmissions of various programming content, such as television and other streaming video services, from the satellite 110 towards the Earth and the respective remote terminals, as illustrated.

With such systems, as is understood in the art, the Sun 105 interferes with communications signals of the system, whereby, for example, the radiated energies from the Sun disrupt or interfere with transmissions from the satellite 110 to one or more of the remote terminals. The interference of the Sun 105 tends to hit a maximum or peak level when the Sun 105, the satellite 110 and the antenna of a remote terminal (e.g., remote terminal 135) are in alignment or conjunction. This alignment is generally illustrated in FIG. 1 with the Sun 105 passing behind the satellite 110, (i.e., from the perspective of the Earthbound antennae) forming a conjunction. As the Sun moves about or traverses the sky, it is clear that a particular moment of maximal or peak interference occurs (i.e., the point in that traversal where the Sun is closest to the point of conjunction). Since the Sun infrequently intersects the antenna-satellite line, i.e., the Sun crosses that line, forming a brief conjunction, these rare events can easily be noted and measurements taken.

Indeed, in the passage of the Sun 105 across any fixed point in the sky, (e.g., the relative position of the aforementioned line between the antenna and the satellite) there are two such conjunctive periods per year, called the Autumnal and Vernal conjunctions or alignments. Each of these conjunctive events generally correspond to a period of maximum signal interference, spikes, noise and outages since the Sun's energies overwhelm and suppress the satellite signals at the respective antennae during these two periods.

These two time periods of maximal signal interference, although presenting significant adverse effects to such satellite communications systems, nonetheless provide helpful information as well. For example, since much of the information about such conjunctions are known, certain antenna pointing determinations can be discerned at the times of the occurrences of these events. Indeed, the precise time and date of respective conjunctions can be predetermined with a high degree of accuracy, and thus the particular time and date of maximal interference of the Sun 105 with a particular satellite/antenna can be pre-determined with precision. By way of example, for each remote terminal antenna or dish, a particular time and date for the conjunction (which generally corresponds to maximum or peak interferences) are known or predictable, based on a number of variables and positional data. These variables or positional data include, for example, the longitude and latitude of a respective remote terminal receiver or antenna, the antenna size, the satellite location, the reception frequency, the particular season (e.g., autumnal or vernal), and the solar ephemeris data or position in the sky. All of these values are known or can be computed for each respective antenna, which data can be stored within the respective terminal (e.g., at the time of installation and/or commissioning), or may be stored in a database hosted at a remote facility, such as a hub site, operations center or data center. Subsequently (e.g., at discrete points in time or periodically), a comparison of the respective pre-computed time and date data with the actual, measured time and date can be employed to diagnose and fix various problems.

With reference now to FIGS. 2A-2L, there is shown a technique or methodology for obtaining those actual measurements for the time and date of peak interference, through illustration of various instances in a progression of solar positions before, during and after the aforementioned time and date of conjunction or maximum interference, particularly over a number of days around the aforementioned point of maximum solar intensity interference. This sequence involves the conjunction of a fixed place on Earth, an orbiting satellite and the Sun, as generally depicted and described in connection with FIG. 1, particularly and for illustrative purposes, the Sun's various paths relative to a ground-based parabolic reception antenna in Calhoun, Ga., and a satellite at the 72.7 orbital slot at around the time of conjunction.

Figure 2A:
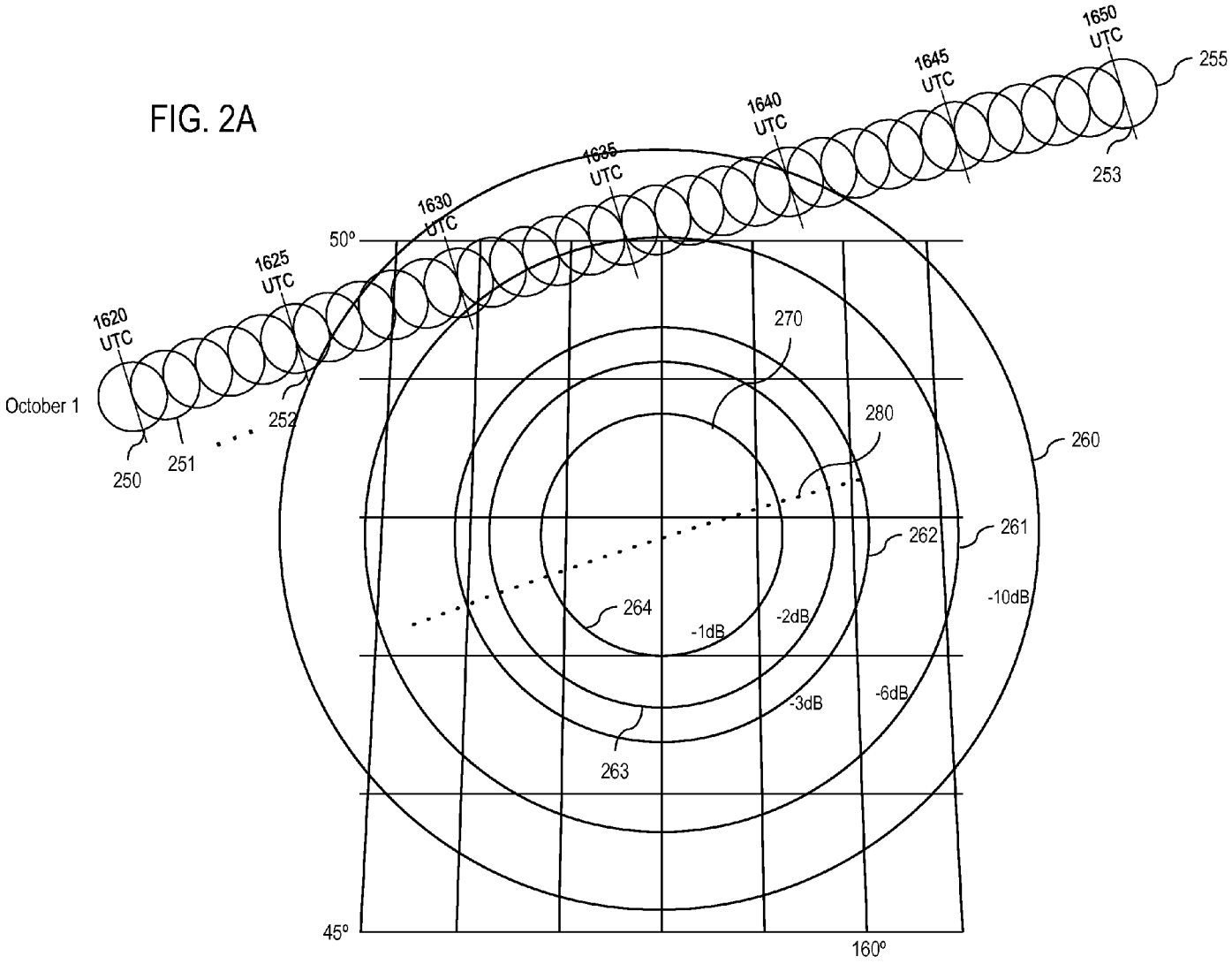
FIGS. 2A-2F illustrate various solar pathways prior to a solar conjunctive event, between a remote terminal and a satellite in communication therewith, and the Sun, in accordance with example embodiments of the present invention.
Figure 2B:
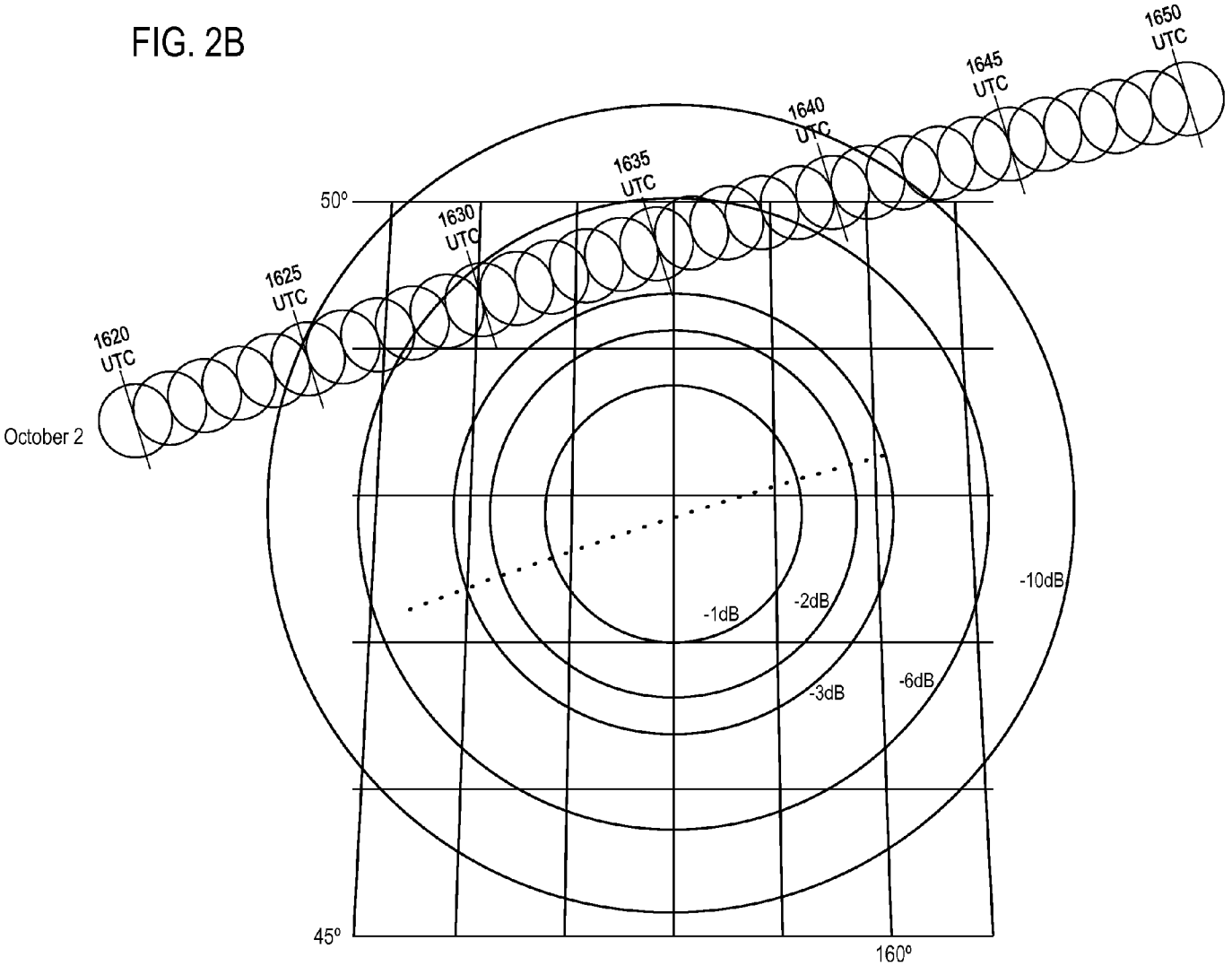
Figure 2C:
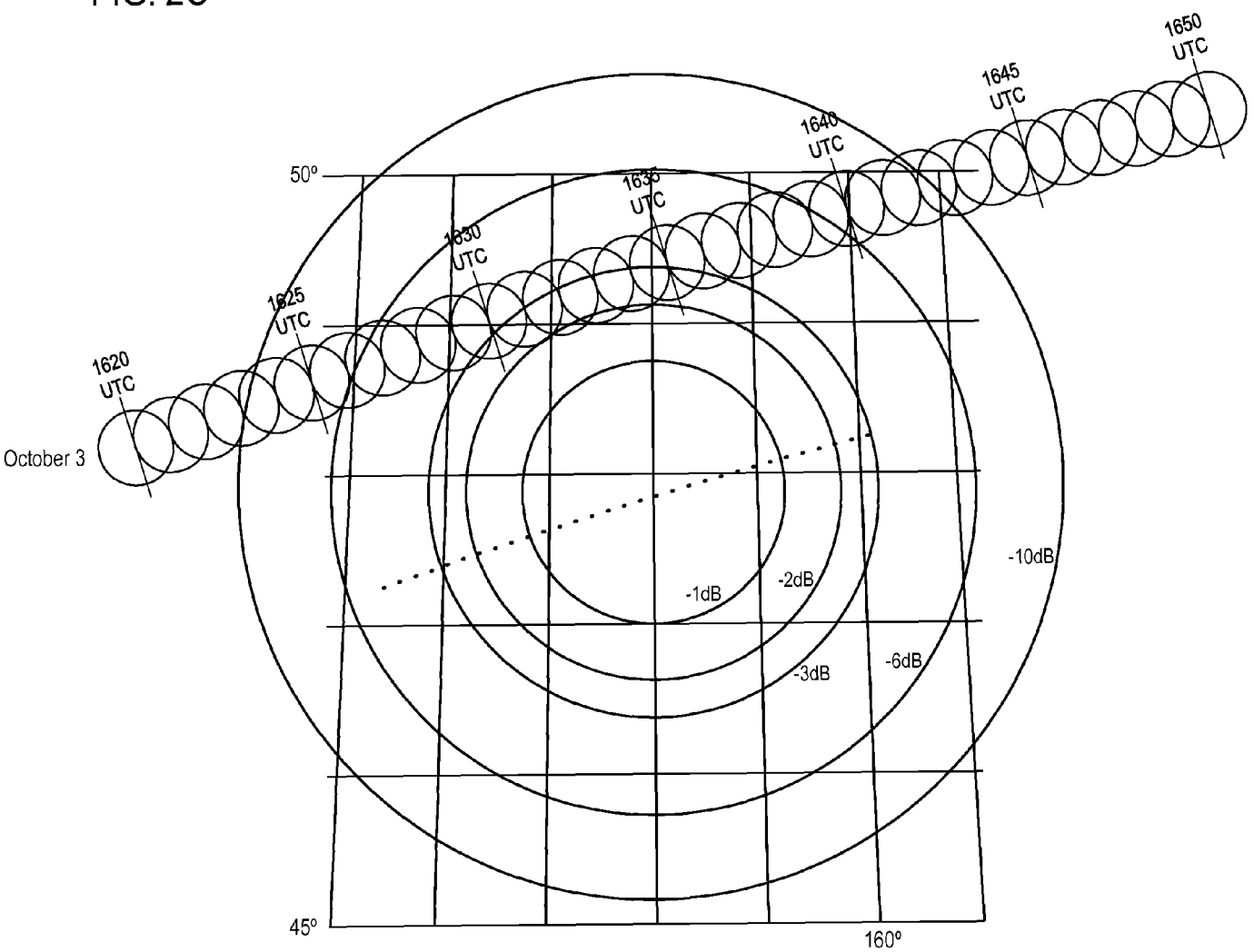
Figure 2D:
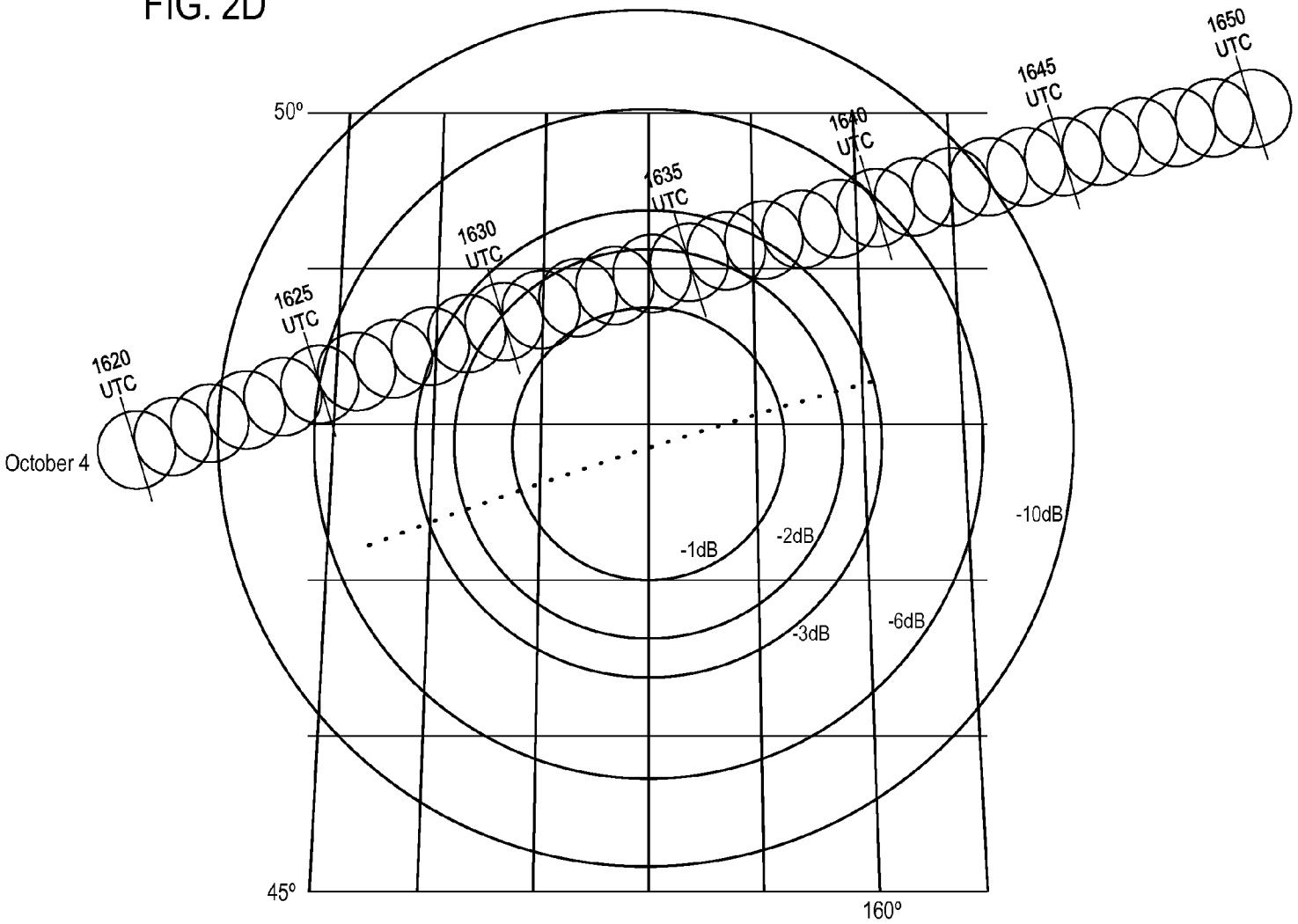
Figure 2E:
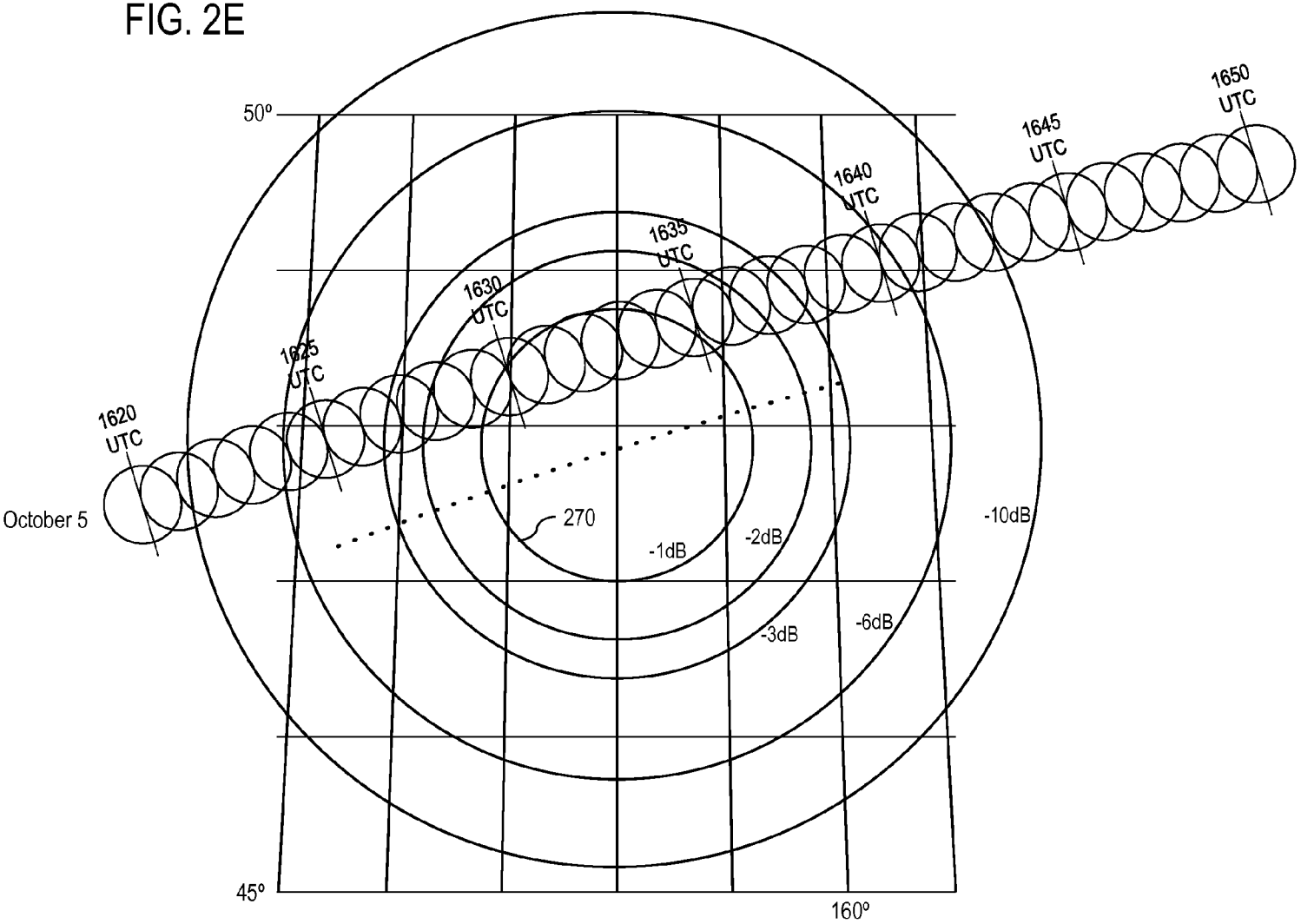
Figure 2F:
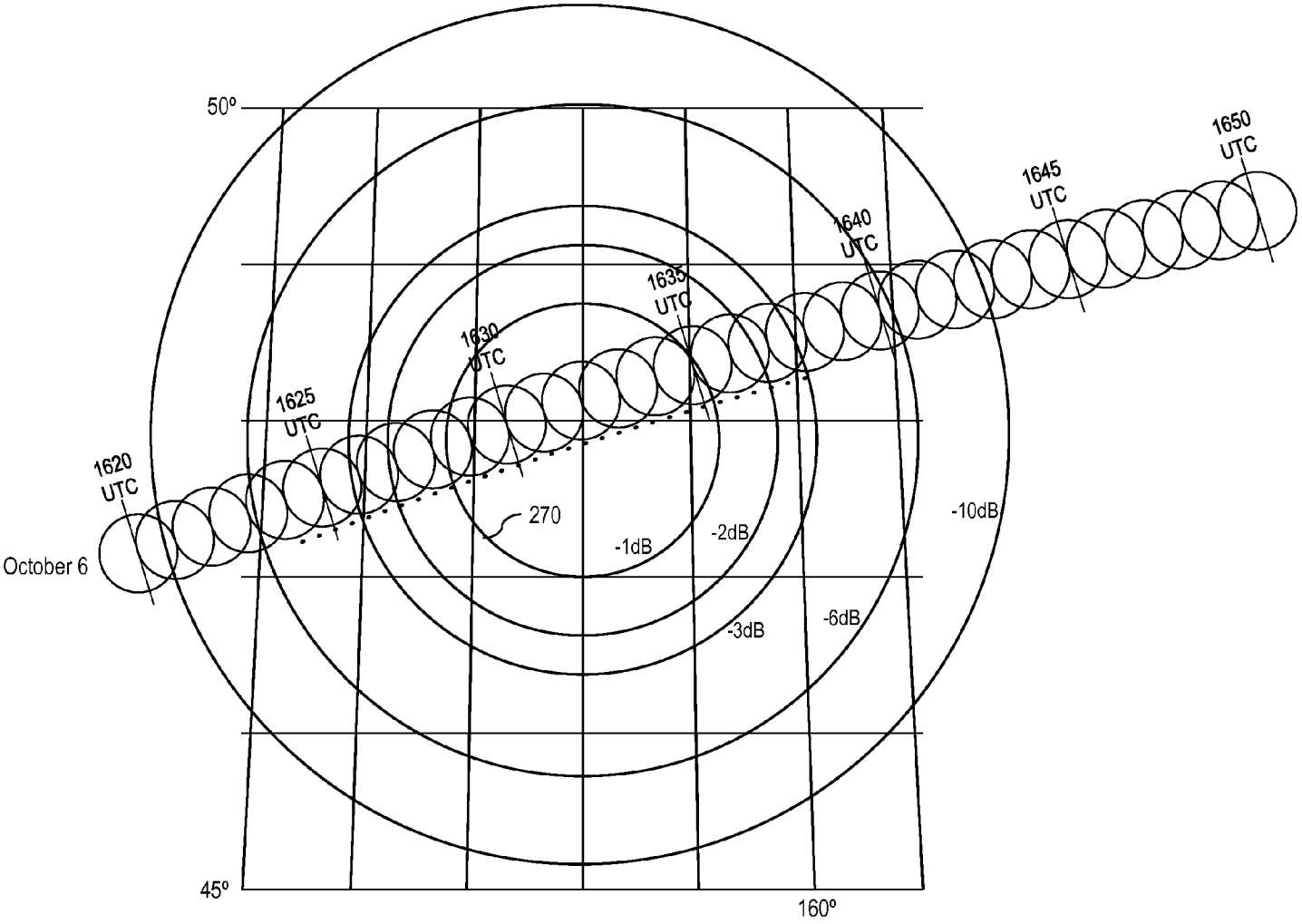

FIGS. 2A-2F illustrate various solar pathways prior to a solar conjunctive event, between a remote terminal and a satellite in communication therewith, and the Sun, in accordance with example embodiments of the present invention. With reference now to FIG. 2A, the positions or pathway of the Sun is shown at various times of an initial date before the conjunction (e.g., at a date where the aforementioned signal degradation or interference begins). The circles 260, 261, 262, 263 and 264 reflect the remote terminal (e.g., a one of the remote terminals 125, 13, 135 of FIG. 1) antenna pointing and positions on the dish or reflection antenna surface, and the relative signal strengths (or losses) of the respective reflective positions on the dish. The solar pathway 255 depicts various positions or ephemeris data for the Sun relative to the pointing of the remote terminal antenna. In this example, the positions reflect roughly one minute intervals spread over roughly one half hour (1620 Coordinated Universal Time (UTC) through 1650 UTC), during which the conjunction occurs. Each of the various concentric circles or boundaries reflects a position of the Sun at a different point in time on a particular day (e.g., October 1, as illustrated in the figure). More specifically, the circle 250 reflects the position of the Sun at 1620 UTC on October 1, the circle 251 reflects the position of the Sun at 1621 UTC on October 1, the circle 252 reflects the position of the Sun at 1625 UTC on October 1, . . . , and the circle 253 reflects the position of the Sun at 1650 UTC on October 1. Further, the points 280 reflect various positions or ephemeris data across a geosynchromous pathway or orbit relative to the pointing of the remote terminal antenna and the solar pathway 255.

Figure 3:
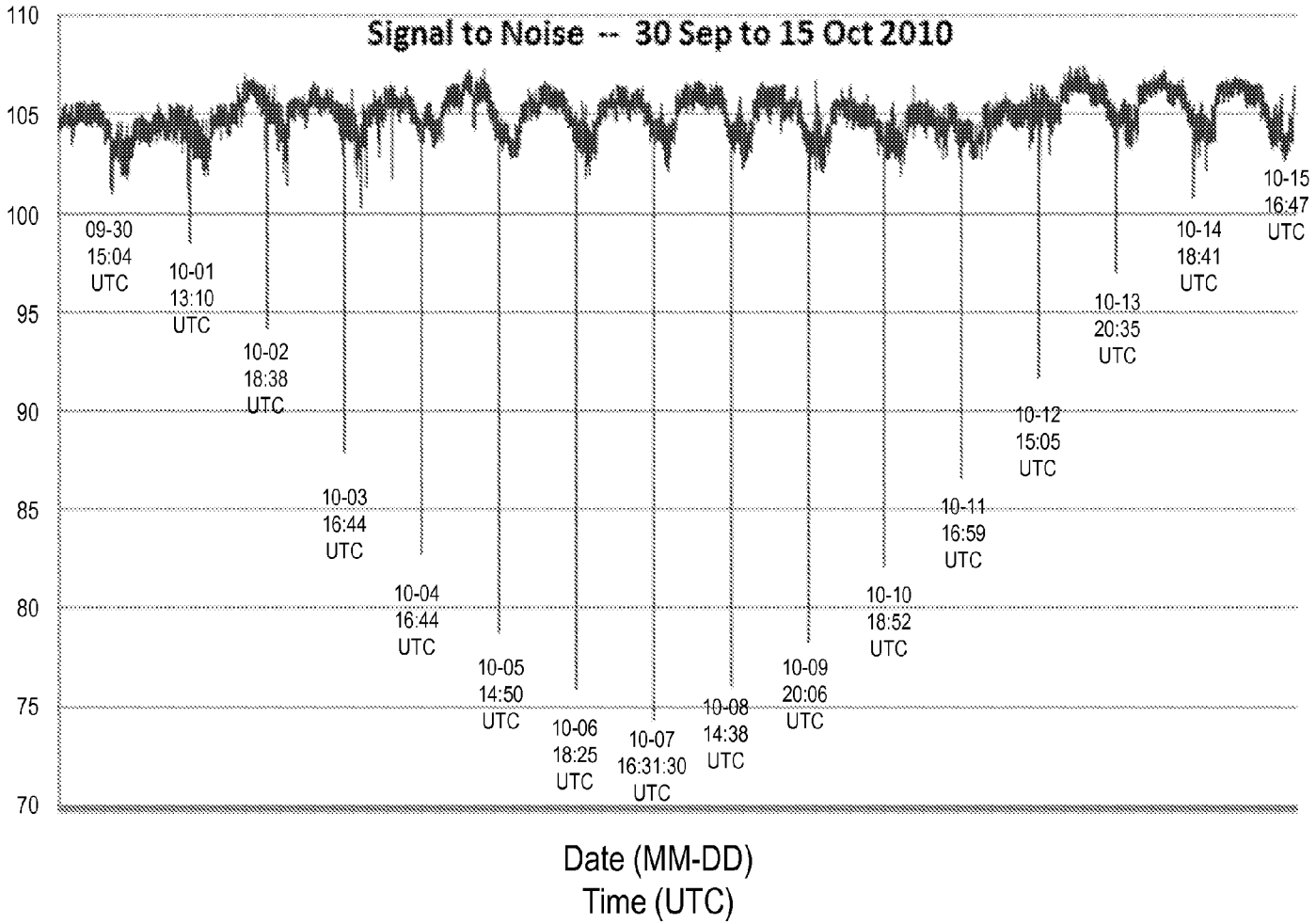
FIG. 3 illustrates a graph of signal to noise ratios with respect to the remote terminal during the period of September 30 through October 15, including the date and timer of the solar conjunctive event between the remote terminal and the satellite in communication therewith, and the Sun, in accordance with example embodiments of the present invention.

Moreover, FIG. 3 illustrates a graph of signal to noise ratios with respect to the remote terminal during the period of September 30 through October 15, including the date and timer of the solar conjunctive event between the remote terminal and the satellite in communication therewith, and the Sun, in accordance with example embodiments of the present invention. While FIG. 3 provides an example illustration based on signal-to-noise measurements, as would be apparent to one of skill in the art, various other signal quality measurement methods may be employed, such as carrier-to-noise measurements, EbNo measurements, or the like. With reference now to FIG. 3, on this date, because the solar pathway 255 is still a relative large distance from the orbit pathway 280 (with respect to the pointing of the remote terminal antenna), the Sun's interference (e.g., as measured by the S/N ratio) is correspondingly low representing minimal interference from the Sun (e.g., as seen from the September 30 to October 1 measurements of FIG. 3). Moreover, as further illustrated by FIG. 3, on any given day, as the Sun traverses across the solar pathway 255, (1) the interference begins at a low point (e.g., corresponding to a time when the Sun intersects with an outer portion of the remote terminal antenna), (2) gradually reach a peak (e.g., corresponding to a point when the Sun intersects the innermost and highest gain point of the antenna), and (3) then gradually diminish as the Sun again traverses back out to the outer portions of the remote terminal antenna.

With reference now to FIGS. 2B through 2F, over the dates October 2 through October 6, the solar pathway 255 gradually moves closer to the orbit pathway 280 (relative to the pointing of the remote terminal antenna). Over these subsequent days the solar pathway 255 moves closer to the orbit pathway 280 (relative to the remote terminal antenna). The measured interference over these days may still be deemed low relative to the peak at the point in time of the conjunction, but increases as the pathways 255 approach the orbit pathway 280 and the point in time of a conjunction. Further, in this example, on October 5 and 6 (FIGS. 2E and 2F), the solar pathway 255 intersects an innermost interference boundary 270 of the remote terminal antenna, where the measured interference during this solar pass will be higher.

Figure 2G:
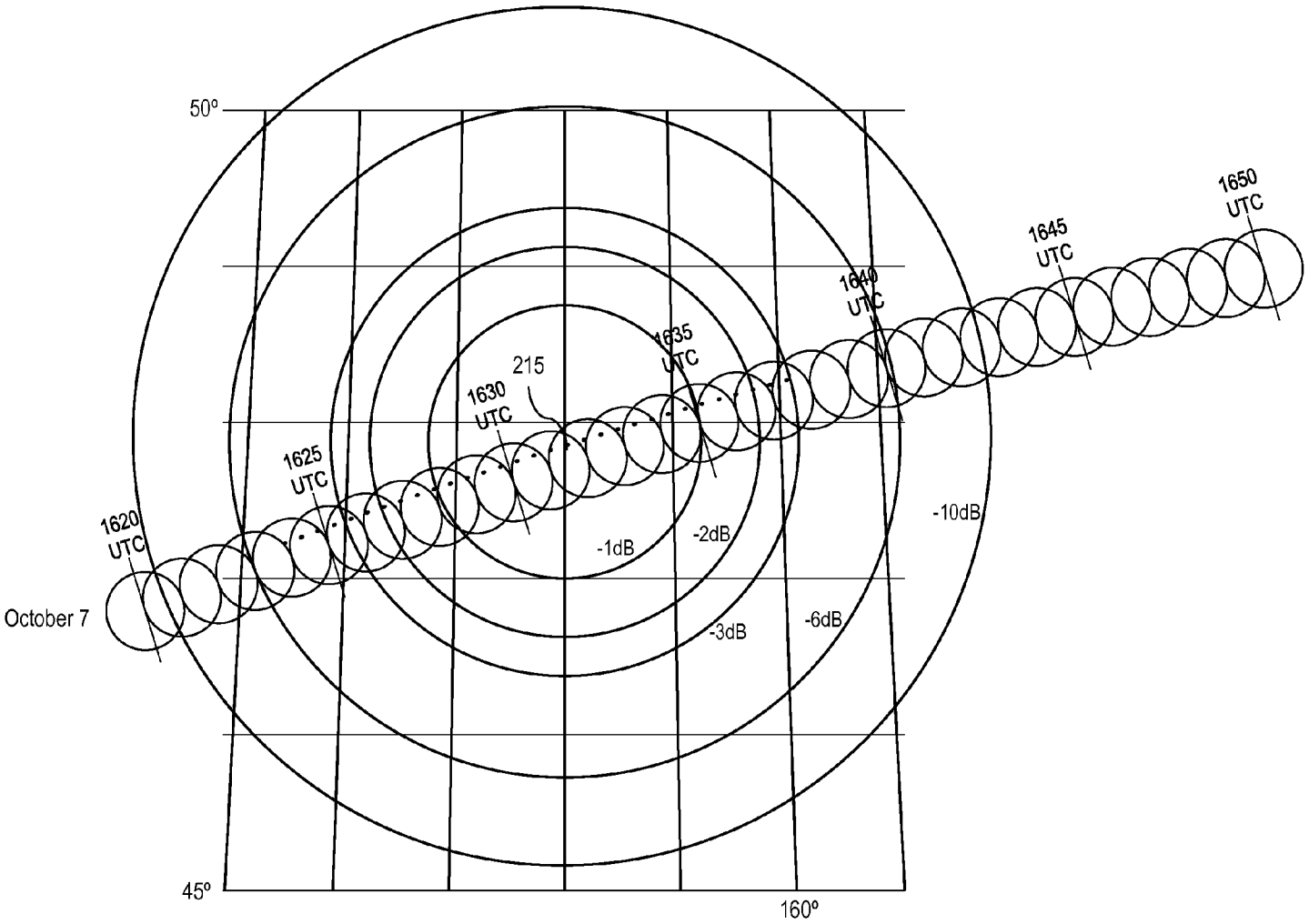
FIG. 2G illustrates a particular solar pathway and a particular solar position, corresponding to a particular date and time, during a solar conjunctive event between the remote terminal and the satellite in communication therewith, and the Sun, in accordance with example embodiments of the present invention.
Figure 2H:
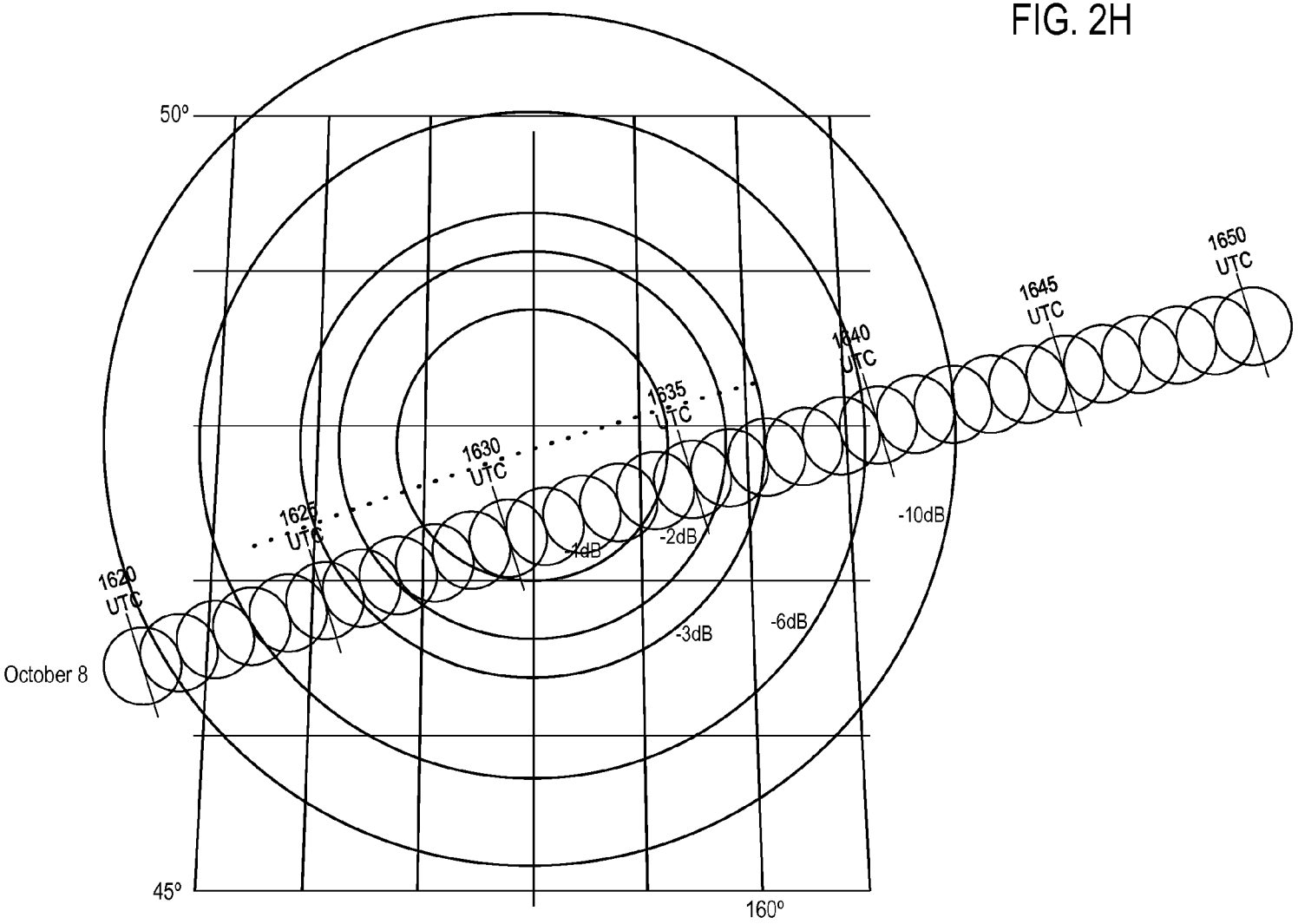
FIGS. 2H-2L illustrate various solar pathways subsequent to the solar conjunctive event shown in FIG. 2G, between the remote terminal and the satellite in communication therewith, and the Sun, in accordance with example embodiments of the present invention.
Figure 2I:
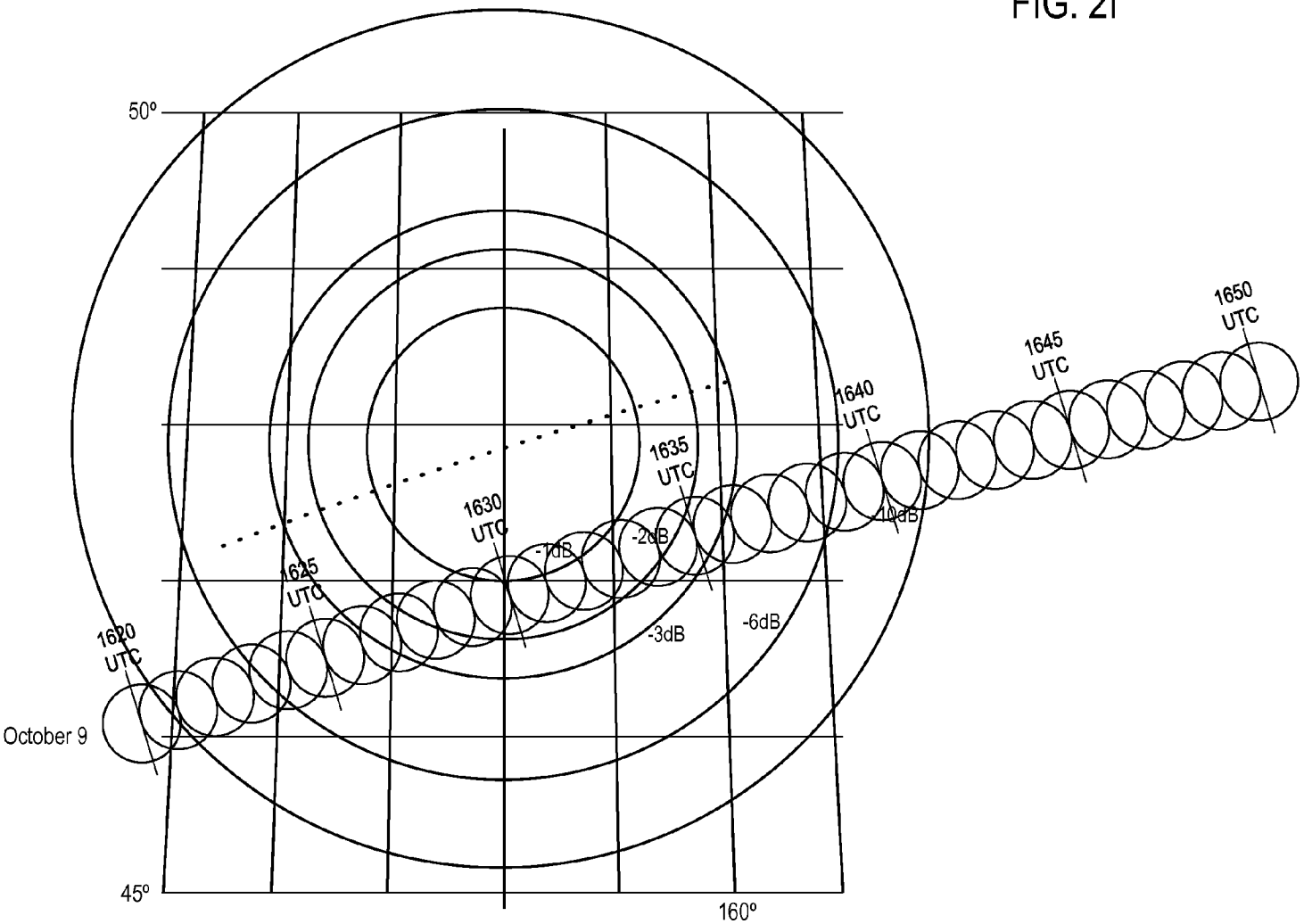
Figure 2J:
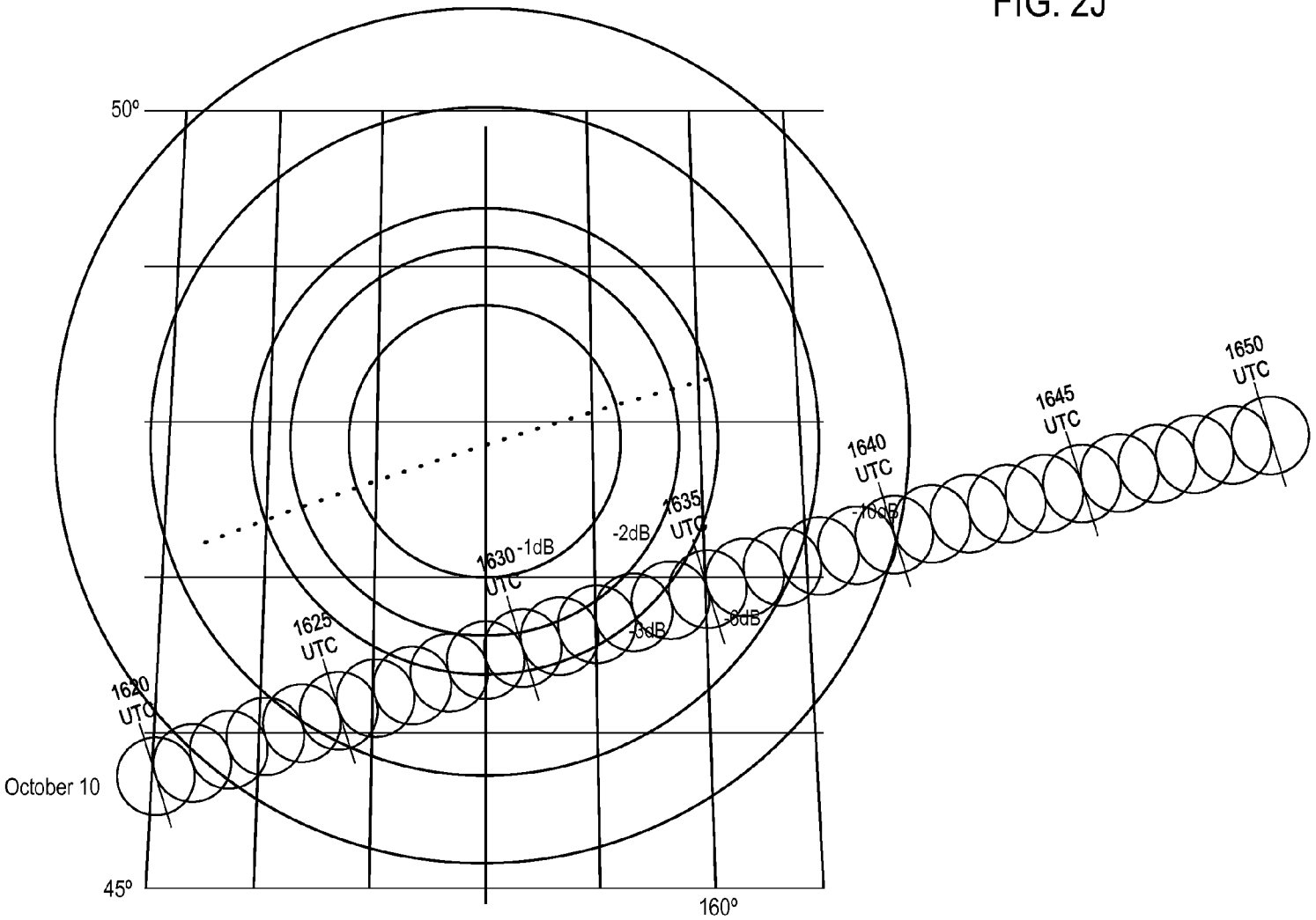
Figure 2K:
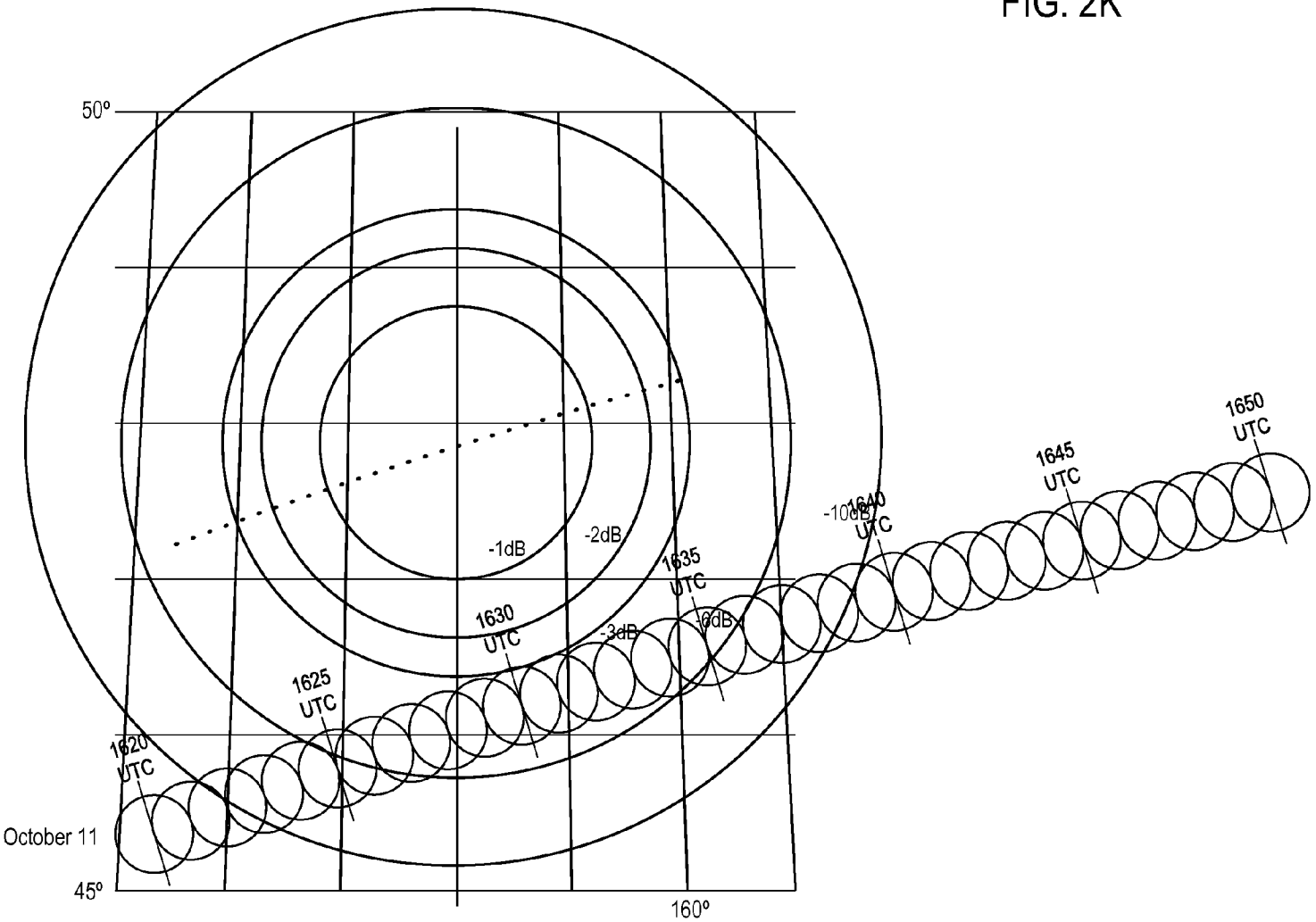
Figure 2L:
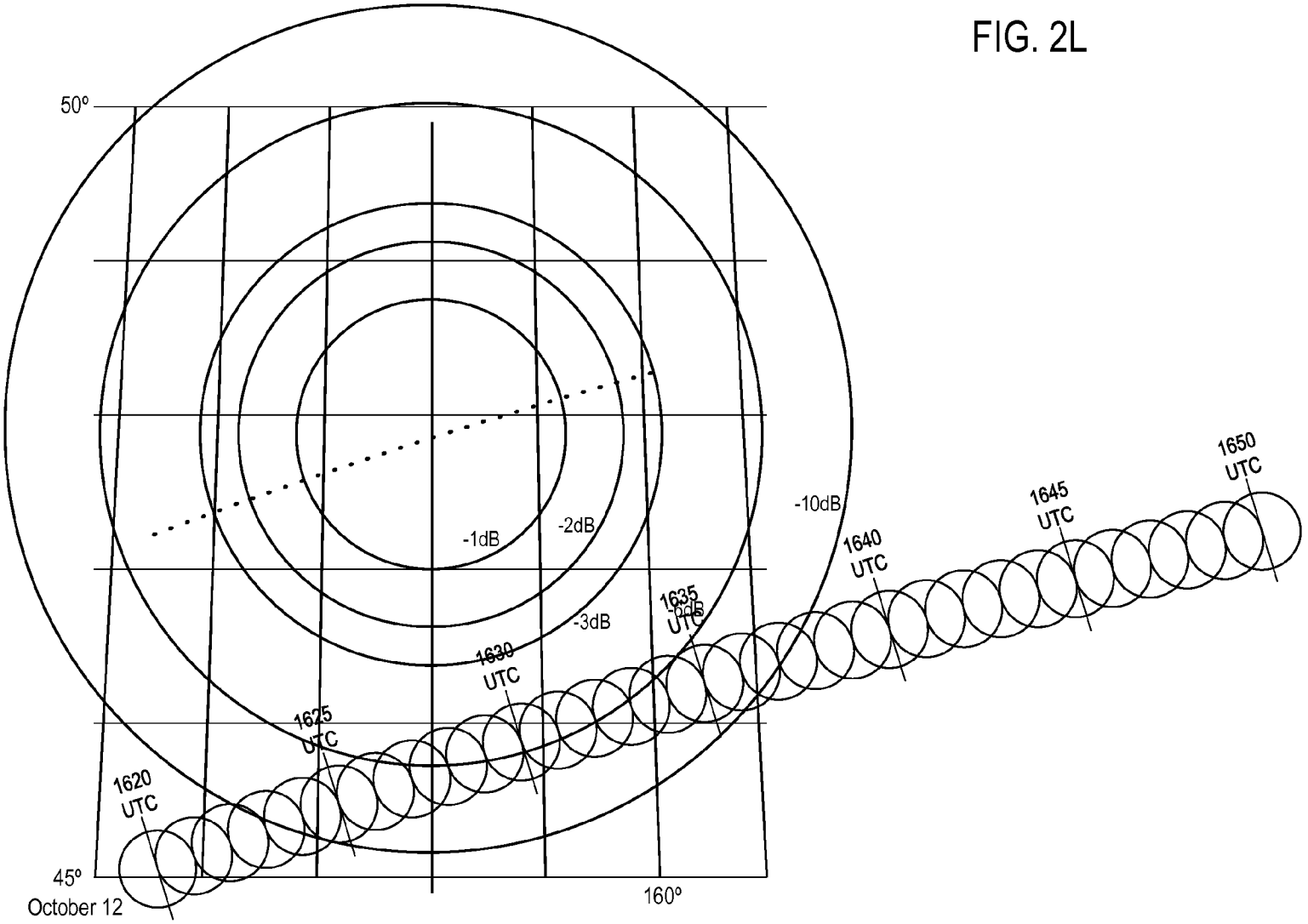

FIG. 2G illustrates a particular solar pathway and a particular solar position, corresponding to a particular date and time, during a solar conjunctive event between the remote terminal and the satellite in communication therewith, and the Sun, in accordance with example embodiments of the present invention. With reference now to FIG. 2G, there is shown the particular solar pathway 255 for the point of peak interference (e.g., the conjunction point 215). Over this solar pathway 255 (e.g., on October 7) the Sun traverses across the points of the orbit pathway 280 with respect to the remote terminal antenna, and reach a point of conjunction 215 when the Sun is relatively in direct alignment with the satellite and the highest gain position of the remote terminal antenna or dish. At that moment or date/time, the intensity of the Sun's interference on the terrestrial equipment 125 and the satellite 110 at the point of the conjunction is at peak. With reference again to FIG. 3, as is illustrated at the point in time on October 7 (at 16:31:30 UTC) the interference of the sun (as reflected by the signal to noise ratio measurements) is at a peak point (a point of peak interference). Further, any offset from that measured peak on that particular pathway 255 to the ideal peak on the ideal peak line 280 can be computed. It should, of course, be understood that the pathways 255 rarely coincide exactly with this orbit 280, but do come substantially close. In any event, it is the detection of the maximal interference to the signals at a respective antenna that is in question, and the measurement for that maximal interference is substantially close to the computed conjunctivity. This particular line 280 of total or complete conjunction is known from the aforementioned variables/data and can be computed.

FIGS. 2H-2L illustrate various solar pathways subsequent to the solar conjunctive event shown in FIG. 2G, between the remote terminal and the satellite in communication therewith, and the Sun, in accordance with example embodiments of the present invention. With reference now to FIGS. 2H-2L, the positions or pathway 255 of the Sun is shown at subsequent times/dates after the conjunction (e.g., from the maximum interference to a time/date where the aforementioned signal degradation or interference wanes).

As the Sun's passage is seasonal, many months later the Sun will begin its traversal in the opposite direction (e.g., creating scenarios generally of a reverse sequence of FIGS. 2A-2L), with another conjunctive date and time being determined. Thus, twice yearly the Sun's pathway 255 crosses (or nearly crosses, as discussed) the conjunction point 215, corresponding to vernal and autumnal conjunctions, and twice yearly the measurements for peak interference of the particular signals for the particular conjunction points 215 involving the particular receivers/antennae can be detected and measured. With the known, predetermined positions of the Sun at those times/dates, the known position of the geosynchronous satellite 110, and the known positions of the particular receivers/antennae on the surface of the Earth, calibrations can be made with regard to those particular receivers/antennae regarding their alignment and other information.

Figure 4:
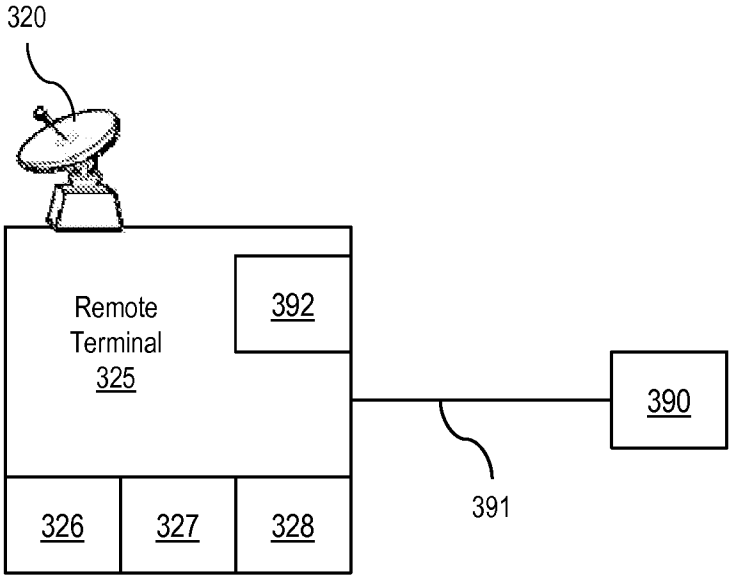
FIG. 4 illustrates a remote terminal system, in accordance with example embodiments of the present invention.

FIG. 4 illustrates a remote terminal system 325, in accordance with example embodiments of the present invention. With reference now to FIG. 4, there is illustrated a representative receiver/antennae 320, which is pointed in the direction of the satellite 110 and to the aforementioned conjunction point 215 and line 280, which the traversing Sun 105 crosses twice yearly. As an object of the invention is to provide a methodology for the respective remote terminal to self-diagnose degrees of alignment or misalignment from these events, the software or commands for these operations are preferably within the respective residential (or other) receivers 325. Accordingly, a processor 326, a memory 327 and a database 328 within a particular terminal arrangement 325 are shown. It should be understood that the database 328 may house a variety of data therein, whether the various positional data, discussed hereinabove, or other data, e.g., the identifications of subscribers in that area, e.g., area 131.

According to an example embodiment of the present invention, the requisite code or software to accomplish the various calculations for the alignment are resident in the memory 327. By way of example, the aforementioned positional data or variables to compute the time and date of maximum intensity (e.g., the longitude and latitude of the particular receiver/antenna 320, the antenna size, the satellite location, the signal reception frequency, the particular conjunction involved (autumnal or vernal), and the particular position or ephemeris data of the Sun at conjunction) can be stored in the memory 327 and/or the database 328. Thus, using these variables or positional data, the particular time and date of the particular conjunction or peak intensity interference for that remote terminal 325 can be calculated (e.g., by the processor 326) and stored (e.g., in the memory 327), awaiting the next conjunction event and new measurements. Furthermore, as described hereinabove, the measured conjunction time and date can be ascertained, with a high measure of accuracy from the degree of signal interference, with computations performed by the processor 326, and the results stored in the memory 327 and/or database 328.

Thus, by way of further example, the predicted and the actual measured time and date of conjunction/maximal intensity interference can be compared, and the results then forwarded or relayed to a central data collection node, generally designated by the reference numeral 390 (e.g., a service provider central control node such as a network operations control center). The conjunction calculations can be performed by a number of remote terminals 325 and the respective conjunctive results from the respective remote terminals in a subscriber area, generally designated by the reference numeral 131, can be forwarded to the central data collection node 390 for analysis. For example, the results can be transmitted via a wireline 391 or a wireless channel 392 to the node 390, via any suitable communications means (e.g., via the Internet, telephone lines, cellular communications, cable connection, or dedicated link, etc.).

The service provider, with the results reported in node 390, can then take requisite actions as deemed necessary (e.g., where a particular dish/antenna is not aligned, such as the dish/antenna 320 of a remote terminal 325, a service call can be arranged to make the requisite alignment to that particular unit instead of making house calls to all subscribers with the area 131). In this manner, service calls can be made only where needed without wasting time on already aligned antennae of respective remote terminals, thereby conserving the service provider's resources and improving the customer experience.

To assist in the alignment, the differences (or lack thereof) between the predicted and measured time and date for conjunction/peak intensity can indicate not only that a misalignment exists, but that a particular corrective action is needed. For example, regarding the time of peak intensity, where the computed and the measured time data of both conjunctions coincide or substantially match, this indicates that the receiver or remote terminal 125 reception antenna was correctly pointed at the satellite 110 along the azimuth axis, i.e., the left/right direction. In the instance, the remote terminal 125 can transmit a positive azimuthal alignment signal to the provider node 390, either via the wireline 391 or wireless 392 connectivity.

Additionally, if the measured time of conjunction/peak intensity interference leads the predicted time for a given remote terminal 325, this indicates that the particular remote terminal 325 is not aligned and corrective alignment is required (e.g., the antenna of the remote terminal 325 is pointed East of the satellite along the azimuth direction, and a leading azimuthal alignment signal can be sent to the node 390). Conversely, where the measured time lags the predicted time, this indicates that the antenna 320 is pointed West of the satellite along the azimuth direction, and a lagging azimuthal alignment signal can be sent to the node 390. In this manner, the aforementioned computations and comparisons can guide the repair or alignment of the remote terminal 325 for optimal reception.

To also assist in the alignment, the differences (or lack thereof) between the predicted and measured date for conjunction/peak intensity interference can indicate that a particular corrective action is needed. For example, where the predicted and the measured date of conjunction/peak intensity interference substantially match, this indicates that the antenna 320 of the remote terminal 325 is properly aligned with the satellite 110 along the elevational axis or direction (e.g., up/down). In this instance, a positive elevational alignment signal is sent to the provider node 390, either via wireline 391 or wireless 392 connectivities.

Where the predicted and measured date do not match, however, then the antenna 320 of the remote terminal 325 is not properly directed to the satellite 110 along the elevational direction and a variety of corrective actions can be implicated, with a negative elevational alignment signal sent to the node 390. It should thus be understood that corrective action here is dependent upon various factors (e.g., whether the Sun's traversal is autumnal or vernal, and which Earth hemisphere is involved, both of which determine the Sun's transit, and the aforementioned negative elevational alignment signal can include a hemisphere indicator and a seasonal indicator). It should, of course, be understood that the processor 326 in making the computations for the conjunction and determination of maximal intensity interference would include the hemisphere and seasonal indicators therein. With this additional information, the requisite corrections along the elevational axis can be made, as is understood to those of skill in the art.

In the above manner, precise alignments to a variety of respective terrestrial equipment can be made (e.g., by a technician making adjustments to remote terminals 325 that are more fixed in place, such as in a typical consumer satellite cable configuration with generally fixed reception dishes). In accordance with alternate embodiments of the present invention, the aforementioned corrections to achieve peak alignment can be performed, for example, by the remote terminal 325 itself, perhaps assisted by commands or signals from the node 390. For example, the remote terminal 325 may be equipped with mechanisms for achieving azimuthal and elevational adjustments under the control of the processor 326 or perhaps remotely (e.g., by a provider at the node 390 employing the landline 391 or wireless 392 connectivity to the respective remote terminal 325). Nonetheless, where the remote terminal are simpler devices (without such alignment control mechanisms, such as general consumer remote terminals in broadcast entertainment systems), physical alignment by a technician would be required to correct any alignment errors and point the dish 325 to the satellite 110. In any event, the techniques and methodologies of example embodiments of the instant invention provide enhanced service capability by providers.

In accordance with further example embodiments, additional determinations can be made based on the determined/collected alignment data and conjunctive information. As discussed, the precise positions for alignment of the particular antennae and satellite 110 to the Sun 250A at the peak intensity interference point are known, where those terrestrial and satellite positions are unique to that conjunction (i.e., the remote terminals 325 being geographically separated have different alignment times/dates even if relatively closet to each other).

With reference again to FIG. 1, the remote terminals 125, 130 and 135 are shown within a subscriber area 131. Since the time and date of conjunction for each remote terminal 125, 130 and 135 position is known (i.e., the conjunctive events for subscribers within a region or area 131 take place relatively close by each other), other remote terminals, such as those geographically outside the authorized area 131 (e.g., a remote terminal 140) will have different times/dates for the conjunctivities (i.e., the measured time and date for maximum interference will not match up to the pre-computed values). For example, the remote terminal 140, being geographically separated from those receivers within the authorized area 131, such as a Canadian remote terminal 140 to a United States area 131, will have GPS-generated or other positional coordinates (e.g., zipcodes) in the pre-computed values.

If, however, the remote terminal 140 fakes coordinates or inputs positional information for authorized users in the area 131 or the remote terminal 140 is moved from an authorized area 131, then the pre-computed data of the remote terminal 140 will mimic that of authorized users. In the case, for example, where a biannual determination and/or recalibration of alignment is performed based on the aforementioned conjunctions, dynamic measurements will be taken to that effect. Then, if the differences between the predicted and the measured times/dates differ substantially or fall outside a particular error or delta or like initial measurement from known authorized reception devices, the remote terminal 140 can be flagged as a possible illegal remote terminal, and an unauthorized usage signal sent, which would preferably include the identity of that remote terminal 140. The provider could then send a technician out to the determined site of the remote terminal 140, determined as part of the aforesaid conjunctions despite the falsified data, or send a signal to the remote terminal 140 to shut down. It should be understood that additional and alternate actions could be taken to identify and interdict unauthorized interception of subscriber transmissions based upon the information gleaned from the solar conjunction/peak intensity interference data employed in practicing the principles of the present invention.

It should be understood that internal GPS or other location systems may be employed to ascertain the exact position of the particular remote terminals 325. It should be understood that the antennae/dish position could alternatively be inserted at installation, either by a technician or by direction of the provider, thereby eliminating a GPS or other positional location equipment in the device 325. It should also be understood that the satellite 110 generally maintains its position in space, e.g., within an operational box, making the conjunction calculations generally correct or within a degree of error tolerance.

The foregoing description of the present invention provides illustration and description, but is not intended to be exhaustive or to limit the invention to the precise one disclosed. Modifications and variations are possible consistent with the above teachings or may be acquired from practice of the invention. Thus, it is noted that the scope of the invention is defined by the claims and their equivalents.

What is claimed is:

1. An apparatus comprising:

a memory configured to store positional data for an antenna of a remote terminal;

a processor configured to determine a point in time for an expected conjunction of the antenna, a satellite in communication with the remote terminal and the Sun, based at least in part on the positional data; and a detector configured to measure, at each of a plurality of points in time, a respective interference level imposed by the Sun on communication signals between the antenna and the satellite;

wherein the processor is further configured to:

determine a one of the points in time when the interference level is at a peak level, and to determine information regarding alignment of the antenna with respect to the satellite, wherein:

the determination of the antenna alignment information is based at least in part on a comparison between the one point in time of the peak interference level and the expected point in time of the conjunction of the antenna, the satellite and the Sun; and shutdown the remote terminal at least partially based on the determination of the antenna alignment information.

2. The apparatus according to claim 1, wherein the positional data comprises one or more of a longitude and latitude of the antenna, an antenna size, a satellite location, a communication reception frequency, seasonal data, and solar ephemeris data.

3. The apparatus according to claim 1, wherein the determination of the one point in time when the interference level is at the peak level comprises determining an initial interference level of the Sun at a point in time prior to the point in time when the interference level is at the peak level, determining increasing interference levels of the Sun at respective points in time subsequent to the initial interference level, and determining the peak interference level at the one point in time after which the measured interference levels of the Sun progressively decrease.

4. The apparatus according to claim 1, wherein, if the processor determines a substantial match between the one point in time of the peak interference level with the expected point in time of the conjunction of the antenna, the satellite and the Sun, then the processor initiates transmission of a positive alignment signal.

5. The apparatus according to claim 1, wherein, if the processor determines that the one point in time of the peak interference level leads the expected point in time of the conjunction of the antenna, the satellite and the Sun, then the processor initiates transmission of a leading alignment signal.

6. The apparatus according to claim 1, wherein, if the processor determines that the one point in time of the peak interference level lags the expected point in time of the conjunction of the antenna, the satellite and the Sun, then the processor initiates transmission of a lagging alignment signal.

7. The apparatus according to claim 1, wherein the comparison of the one point in time of the peak interference level with the expected point in time of the conjunction of the antenna, the satellite and the Sun includes one or more of a hemisphere indicator and a seasonal indicator.

8. The apparatus according to claim 1, wherein the processor is further configured to determine an unauthorized operation of a remote terminal based on one or more of the one point in time of the peak interference level, the comparison between the one point in time of the peak interference level and the expected point in time of the conjunction of the antenna, the satellite and the Sun, and the antenna alignment information.

9. The apparatus according to claim 8, wherein the processor is further configured to initiate transmission of an unauthorized terminal message upon making a determination of an unauthorized operation of a remote terminal.

10. The apparatus according to claim 9, wherein the unauthorized terminal message includes one or more of information identifying the unauthorized remote terminal and information indicating a location of the unauthorized remote terminal.

11. A method comprising:

determining a point in time for an expected conjunction of an antenna of a remote terminal, a satellite in communication with the remote terminal and the Sun, based at least in part on predetermined positional data;

measuring, at each of a plurality of points in time, a respective interference level imposed by the Sun on communication signals between the antenna and the satellite;

determining a one of the points in time when the interference level is at a peak level;

determining information regarding alignment of the antenna with respect to the satellite, wherein the determination of the antenna alignment information is based at least in part on a comparison between the one point in time of the peak interference level and the expected point in time of the conjunction of the antenna, the satellite and the Sun; and performing a realignment of the antenna based on the determined information regarding alignment of the antenna with respect to the satellite.

12. The method according to claim 11, wherein the positional data comprises one or more of a longitude and latitude of the antenna, an antenna size, a satellite location, a communication reception frequency, seasonal data, and solar ephemeris data.

13. The method according to claim 11, wherein the determination of the one point in time when the interference level is at the peak level comprises determining an initial interference level of the Sun at a point in time prior to the point in time when the interference level is at the peak level, determining increasing interference levels of the Sun at respective points in time subsequent to the initial interference level, and determining the peak interference level at the one point in time after which the measured interference levels of the Sun progressively decrease.

14. The method according to claim 11, wherein, if a substantial match is determined between the one point in time of the peak interference level with the expected point in time of the conjunction of the antenna, the satellite and the Sun, then the method further comprises transmitting a positive alignment signal.

15. The method according to claim 11, wherein, if it is determined that the one point in time of the peak interference level leads the expected point in time of the conjunction of the antenna, the satellite and the Sun, then the method further comprises transmitting a leading alignment signal.

16. The method according to claim 11, wherein, if it is determined that the one point in time of the peak interference level lags the expected point in time of the conjunction of the antenna, the satellite and the Sun, then the method further comprises transmitting a lagging alignment signal.

17. The method according to claim 11, wherein the comparison of the one point in time of the peak interference level with the expected point in time of the conjunction of the antenna, the satellite and the Sun includes one or more of a hemisphere indicator and a seasonal indicator.

18. The method according to claim 11, further comprising:

determining an unauthorized operation of a remote terminal based on one or more of the one point in time of the peak interference level, the comparison between the one point in time of the peak interference level and the expected point in time of the conjunction of the antenna, the satellite and the Sun, and the antenna alignment information.

19. The method according to claim 18, further comprising:

transmitting an unauthorized terminal message upon making a determination of an unauthorized operation of a remote terminal.

20. The method according to claim 19, wherein the unauthorized terminal message includes one or more of information identifying the unauthorized remote terminal and information indicating a location of the unauthorized remote terminal.

* * * * *